US006702383B2

(12) United States Patent
Newman et al.

(10) Patent No.: US 6,702,383 B2
(45) Date of Patent: Mar. 9, 2004

(54) ELECTRIC LIFTING CUSHION

(76) Inventors: Duncan Newman, 314 Kenilworth Ave., Toronto, Ontario (CA), M4L 2S8; Michael A. Knappers, 148 Holborne Ave., Toronto, Ontario (CA), M4L 2R6

( * ) Notice: Subject to any disclaimer, the term of this patent is extended or adjusted under 35 U.S.C. 154(b) by 0 days.

(21) Appl. No.: 09/986,737

(22) Filed: Nov. 9, 2001

(65) Prior Publication Data

US 2003/0090135 A1 May 15, 2003

(51) Int. Cl.[7] ..... A61G 15/00
(52) U.S. Cl. ..... 297/313; 297/330; 297/DIG. 10
(58) Field of Search ..... 297/313, 330, 297/DIG. 10, 338, 339

(56) References Cited

U.S. PATENT DOCUMENTS

| | | | | | |
|---|---|---|---|---|---|
| 3,091,426 | A | * | 5/1963 | Bogart | 297/330 |
| 3,250,569 | A | | 5/1966 | Gaffney | 297/330 |
| 3,659,897 | A | | 5/1972 | Wright | 297/DIG. 10 X |
| 4,688,851 | A | | 8/1987 | Whiteford | 297/313 |
| 4,838,612 | A | * | 6/1989 | Cross | 297/313 |
| 5,082,327 | A | | 1/1992 | Crisp | 297/313 |
| 5,116,100 | A | | 5/1992 | Iversen | 297/313 |
| 5,165,753 | A | * | 11/1992 | Henderson | 297/330 X |
| 5,294,179 | A | * | 3/1994 | Rudes et al. | 297/330 |
| 5,316,370 | A | | 5/1994 | Newman | 297/313 |
| 5,333,931 | A | * | 8/1994 | Weddendorf | 297/330 X |
| 5,346,280 | A | * | 9/1994 | Deumite | 297/330 |
| 5,375,910 | A | | 12/1994 | Murphy | 297/313 |
| D359,191 | S | | 6/1995 | Whitebread | 297/DIG. 10 X |
| 5,505,518 | A | | 4/1996 | Pike | 297/DIG. 10 X |
| 5,641,201 | A | * | 6/1997 | Casey et al. | 297/DIG. 10 |
| 5,803,545 | A | * | 9/1998 | Guguin | 297/330 X |
| 5,898,953 | A | | 5/1999 | Paxon | 297/DIG. 10 X |
| 5,918,936 | A | | 7/1999 | Murphy | 297/313 |
| 5,931,532 | A | * | 8/1999 | Kemmerer et al. | 297/330 |
| 5,988,747 | A | | 11/1999 | Jeans | 297/313 |
| 6,113,188 | A | | 9/2000 | Stewart | 297/DIG. 10 X |
| 6,213,554 | B1 | * | 4/2001 | Marcoux et al. | 297/330 |

FOREIGN PATENT DOCUMENTS

| | | | | | |
|---|---|---|---|---|---|
| GB | 2014844 | A | * | 9/1979 | 297/330 |

* cited by examiner

*Primary Examiner*—Peter M. Cuomo
*Assistant Examiner*—Rodney B. White
(74) *Attorney, Agent, or Firm*—Dowell & Dowell, P.C.

(57) ABSTRACT

An electric seat assist device having a seat pivotally secured to a base. One or more cam members extend in generally opposing relationship from the seat and base and are seated on one or more sets of rollers which are linearly adjusted to raise and lower the seat by a drive member which is pivotally mounted relative to the base and the rollers of the seat assist device. Stroke detectors are used to control motor drivingly connected to the drive member after being activated to initiate raising or lowering of the seat.

20 Claims, 6 Drawing Sheets

ELECTRIC LIFTING CUSHION

BACKGROUND OF THE INVENTION

1. Field of the Invention

This invention relates to devices that can be placed in a conventional chair to aid an occupant in rising from a seated position and also as an aid in lowering to a seated position from standing. The device is of particular value for the weak and the infirm.

2. Brief Description of the Related Art

Many such devices exist and among them is the Uplift Seat Assist, which is a non-powered device which provides a supplementary raising force to a user's own muscles to aid in rising and sitting. Such device is described in U.S. Pat. No. 5,316,370. The present device is an enhancement of that one, wherein the forces are supplied entirely by an electric motor and mechanism and requires no muscular participation from the user.

The design challenge for a compact personal seat assist device is to design a cushion with a motorized mechanism in as flat a form as possible. The reason for the flatter form is to minimize impact on the comfortable seating height of the standard chair, on which the device is placed. Therefore, the intent of this description is to show a solution to the challenges of producing a stable, safe, easy, and powerful lifting seat cushion, which, in the lowered position, is as thin as possible.

SUMMARY OF THE INVENTION

The present invention is directed to an electric lifting cushion or seat assist device which, in a preferred embodiment, includes a seat pivotally secured adjacent one end to a frame or base and which is also connected by a linkage which extends upwardly adjacent opposite sides of the base to one or more bearings associated with an underside of the seat. In a preferred embodiment, the linkage is a generally U-shaped element pivoted in bearings to the base and in pair of bearings to the underside of the seat.

At least one set of generally opposing cam members or plates are secured and extend in off-set manner toward one another from each of the underside of the seat and upwardly from the base which cam members taper downwardly toward the rear portion of the seat assist device. In preferred embodiments, at least two pair of such cam members or plates are provided in spaced relationship with respect to one another extending from each of the seat and the base.

In order to elevate or lower the seat relative to the base, an elevation control member is provided. The control member in a preferred embodiment includes at least one pair of rollers which are engageable one with the cam member extending from the seat and the other with the cam member extending upwardly from the base. In embodiments which incorporate a plurality of cam members or plates, a separate roller set is provided for each opposing pair of cam members.

In accordance with the invention, each pair of rollers are connected to a drive mechanism which is operable upon the activation of an electric motor to move the set of rollers linearly. As the rollers track along the opposing cam surfaces in a first direction toward the front of the seat assist device, the seat will be elevated relative to the base. In a like manner, by reversing the direction of movement, the seat can be lowered relative to the base. In a first embodiment, the operating mechanism is attached to the motor by a pivot coupling such that an angle of inclination of the drive mechanism may be continuously changed depending upon the linear position of the set of rollers.

In preferred embodiments, the rollers are carried by a cross beam member, which also mounts a nut which is traversed by a lead screw which forms part of the drive mechanism. The nut is pivotally carried by the cross beam member such that the beam is pivotal about an axis which is substantially normal to rotational axes of both the rollers and the lead screw so as to compensate for torsional flexure of the seat. In a first preferred embodiment, one end of the lead screw is pivotally connected to a coupling member secured to an output of an electric motor which may be either powered by an AC power source or a DC battery power source. In accordance with the invention, the vertical angle of the lead screw changes depending upon the vertical movement of the roller set relative to the surface of the cam members or plates, such that there is no binding of the lead screw during the linear adjustment of the roller sets to raise and lower the seat relative to the base of the seat assist device.

In other preferred embodiments of the invention, as opposed to having the lead screw pivoted through a coupling connected to the drive motor, the drive motor made be operably connected to the lead screw with the motor and operable connection being mounted to a pivot plate which allows for the angle of inclination of the lead screw to change as the rollers travel along the cam members or plates.

The present invention also incorporates a control mechanism for terminating the activation of the electric motor depending upon the position of the roller sets relative to the opposing cam members or plates. In a preferred embodiment, sets of electrical contacts are mounted in a housing adjacent to the motor. The electrical contacts are bridged by a contact switch which is toggled between the various contacts by being engaged or connected to a slide switch plate at one end and having an opposite end secured to be moved under the influence of an operating handle. The operating handle is connected by a crank shaft to a forward end of the slide switch plate and the slide switch plate is also connected to a resilient member which normally tends to move the slide switch plate such that the electrical contacts of the contact or toggle switch are biased to an open position to prevent the supply of power to the drive motor. By movement of the operating handle in a first direction, the slide switch plate is moved against the spring such that the toggle switch contacts bridge contacts to operate the motor. When pressure is released from the operating handle, the spring returns the slide switch to a position in which electrical contact is disengaged to the motor. If pressure is maintained on the operating handle, the cross beam associated with the roller sets will engage a flange on the slide switch plate to thereby urge the toggle switch to an off position relative to the motor contacts. To reverse the direction of the motor, the handle is moved in a different direction causing the slide switch plate to move the toggle switch contacts to bridge separate motor contacts causing a reverse rotation of the motor which contact is broken when the cross beam associated with the roller sets reaches a position in which an element extending therefrom engages the slide switch plate thereby moving a slide switch plate to move the electrical contacts of the toggle switch to an off position.

It is the primary object of the present invention to provide an electric lifting cushion or electric seat assist device which is very compact in configuration but which provides a lifting force to assist an individual in both rising from a seated position or moving from a standing position to a seated position without the user having to use their own muscles to aid in rising and sitting.

It is another object of a preferred embodiment of the present invention to provide a seat assist device having a seat which is raised and lowered by a low-power electric motor and wherein the mechanical mechanism utilized incorporates one or more roller sets engageable with cam surfaces associated with a seat and base of the device and wherein the one or more roller sets are carried by a memeber which is pivotal about an axis which is substantially normal to the rotational axes of both the rollers and the drive element and which drive element is also either pivotally coupled to the motor such that the drive element may be pivoted in a vertical plane or the motor is operatively connected to the drive element such that the motor and drive element pivot vertically.

It is also an object of the present invention to provide an electric lifting cushion or seat assist device which can be manually controlled by a lever or other operating member which is connected to control the operation of an electric motor mounted to the base of the device such that when the seat associated with the device approaches a fully raised or fully lowered position, power to the motor is automatically terminated.

BRIEF DESCRIPTION OF THE DRAWINGS

A better understanding of the invention will be had with reference to the accompanying drawings, wherein.

DESCRIPTION OF THE PREFERRED EMBODIMENT

Figure 1:
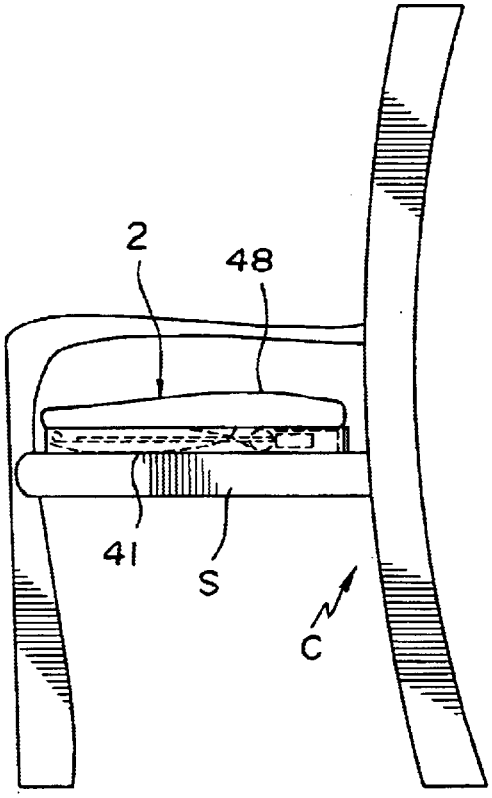
FIG. 1 is a side illustrational view of a first embodiment of seat assist device of the invention positioned on a conventional chair in a lower position functioning as a supplement seat cushion.
Figure 2:
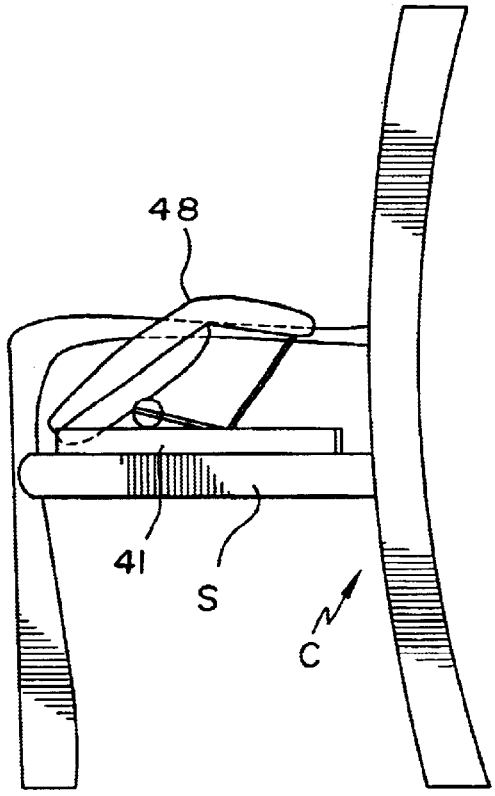
FIG. 2 is a view similar to FIG. 1 showing the seat assist device of FIG. 1 elevated to a raised position.

With specific reference to FIGS. 1 and 2, the electrical lift cushion or seat assist device 2 of the present Ad invention is shown as being positioned on a conventional seat of a chair "C". The device includes a base 41 to which is pivotally mounted a cushioned seat 48. The seat is shown in a fully lowered position in FIG. 1 and in a fully raised position in FIG. 2. The structure of the seat assist device and the operation thereof will be fully described hereinafter.

Figure 3:
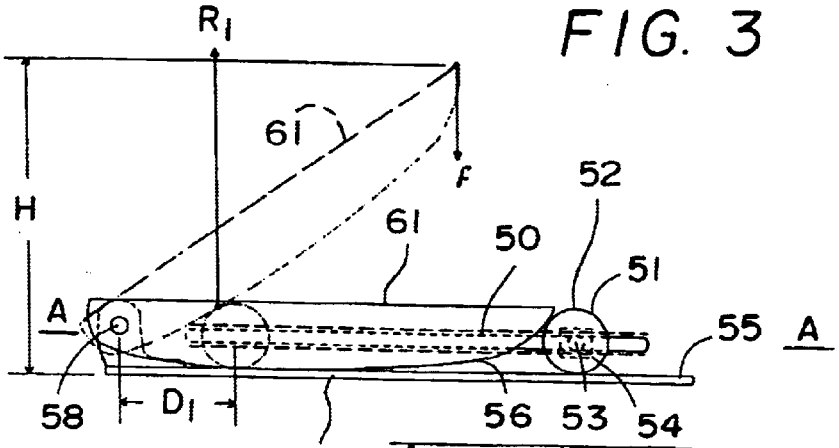
FIG. 3 is a side view of a seat assist device illustrating one manner in which a seat may be elevated relative to a base.
Figure 4:
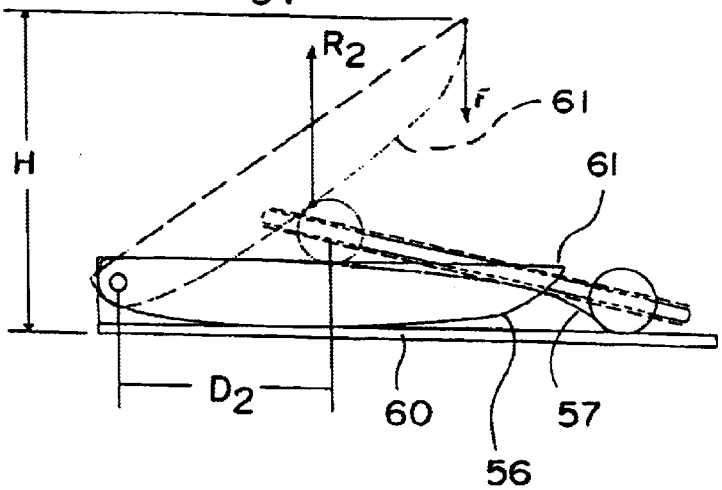
FIG. 4 is a view similar to FIG. 3 illustrating a preferred and improved manner of elevating a seat relative to a base according to the invention.

To aid in the understanding of the invention, FIGS. 3 and 4 show the principle used. To bring about lifting, a seat assist device includes a scissor mechanism having two components, a base 60 and seat portion 61 hinged at position 58 on FIG. 3, and forced to separate by the motion of a set of spaced rollers, 51 and 52, each on a common axle 53, and which are driven linearly along an axis A—A of a power screw, 50. In FIG. 3, as the rollers 51 and 52 move from right to left, a cam surface, 56, is forced to rise. In the raised position the height achieved is shown as dimension "H". In FIG. 3, the rollers roll along the base 60 and when the height "H" is achieved, the rollers are at distance $D_1$ from the hinge, 58. The reaction force, R1, which is produced by the force F, the weight of the person sitting on it, is high because of $D_1$ being necessarily small. This requires a heavy and rigid structure to withstand the high bending moment that results.

FIG. 4 shows a way of achieving a high lifting height from a thin platform, while keeping the load reasonable and not requiring as strong a structure. In this case, two cam surfaces 56 and 57 are scissored together. Thus the forward action of the lead screw 50 gives lifting of both upper cam surfaces 56 and the rollers 51 and 52. This requires the drive screw to tilt vertically as the rollers proceed. The detail of this inventive aspect will be described in the body of description to come. However, the important principle is that, in FIG. 4, the same height "H", is achieved, but at a much longer distance, D2; thus causing lower reaction force, R2. Therefore, the necessity of a heavy structure is alleviated.

Figure 5:
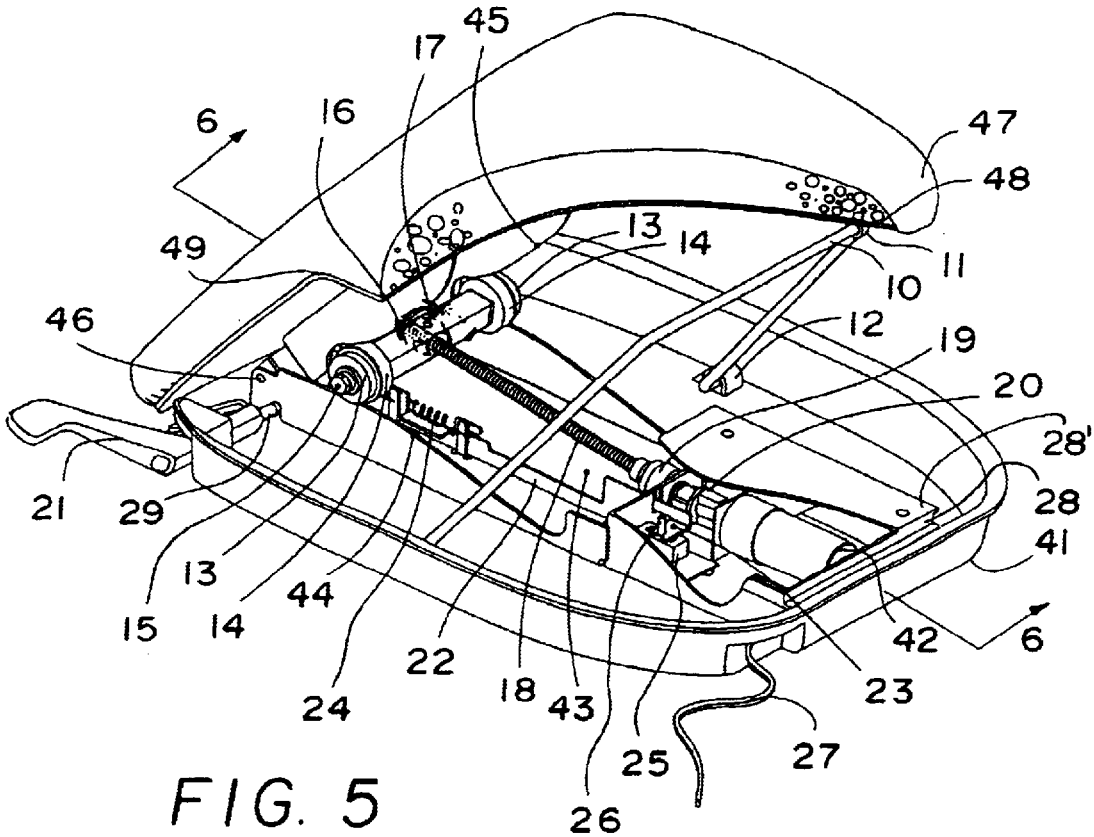
FIG. 5 is a front perspective view of the seat assist device of FIG. 1 shown in a raised position and having portions broken away.

In FIG. 5, all components of a first embodiment of the seat assist device of the invention are shown in an open or raised position. The design employs two main components including a base 41 and a seat 48. Attached to the seat is a cushioning material 47 for comfort. The seat 48 is a flexible thermoplastic and is allowed to effectively hinge along a line 49. In the raised position, a parallelogram, commonly known as a four-bar linkage is formed by the seat, base and a rear U-shaped linkage 10, which is allowed to rotate at spaced bearings 11 on the seat and at bearings 12 on opposite sides of the base. The base 41 is a large pan-shaped plastic molding. Mounted within the base is a metallic frame 43 including spaced vertically oriented cam members or plates 44 having contoured upper surfaces which elevate toward the front of the seat assist device. Secured to the lower surface of the seat 48 is another metallic frame 45A having spaced and depending cam members or plates 45 which are slightly offset with respect to the cam plates 44 of the frame 43. The metallic frames 43 and 45A are pivotally connected at 46 and thus form a pivotal connection of the seat 48 to the base 41. It should be noted that the metallic frame 45A, and thus the cam plates 45, do not extend across the living-hinge area 49 of the seat.

the rear of the lower frame 43 is a motor drive system. An electric motor 42 is provided which is a small motor of approximately 25 Watts with appropriate output gear box 42B. A drive shaft 42A of the motor is allowed to transmit torque via a coupling 20 to a drive screw 18 which is operably connected to an elevation control member or assembly for raising and lowering the seat. The transmission is accomplished through a thrust bearing 19 which is described in the later figures. In a preferred embodiment, the drive screw 18 rotates in a drive nut 17. This nut allows a cross beam 16 to rock about a generally vertical axis, as shown by the arrow in FIG. 5. The pivotal mounting of the nut permits an equalizing of the loads on the rollers by allowing the beam to rock and thereby balance the forces on the rollers and compensate for torsional flexure of the components of the seat and base due to off-center weight loading of an individual using the seat assist device. This allows use of light weight components which can flex, reduces force on the drive element and allows use of a low power motor compared to a more rigid structure. The beam 16 holds two axial bolts 15, one on either end, about which pairs of rollers are allowed to freely revolve. The outer rollers 13 are designed to roll along the surface of the lower cam plates 44 while the inner rollers 14 are allowed to roll (in an opposite direction) along the surface of the upper cam plates 45. Therefore, these rollers counter-rotate as the cross beam passes from the rear of the seat assist device to the front, as shown in FIG. 6, thus spreading the upper and lower frames and cam plate structures apart about spaced pivot points 46, thereby raising the seat.

Further details of the seat assist device have to do with the activation of the elevating device and detection of an end of the stroke of a drive mechanism. The user causes the cushion to operate under either power lifting or lowering mode by pulling up or pushing down a lever 21. This causes rotation of a shaft cam 29 which causes the sliding of a switch plate 22 which in turn actuates a toggle switch 26 within a switch box 25 which makes electrical contacts causing either forward or reverse motion of the motor in an "H-bridge" scheme common to reversing motor designs. The switch 26 thus has space contacts 26A and 26B. Power is supplied by either DC battery (not shown) or AC by power cord 27. The entire electrical assembly is contained in a closed safety box or housing 28 of injection mold plastic and covered by a lid 28'.

Figure 6:
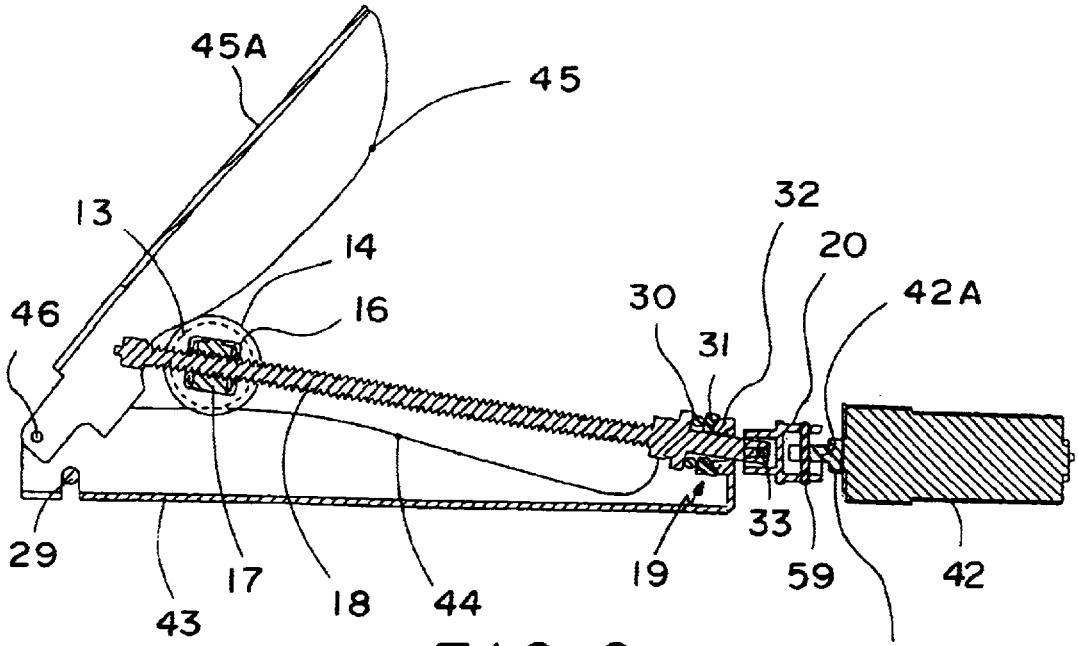
FIG. 6 is a partial cross sectional view taken along line 6—6 of FIG. 5.

FIG. 6 shows a cross section along section line 6—6 of FIG. 5, and the principal components of the drive mechanism can be seen, hatched in cross section. Referring again from the right hand side, the motor 42 drives a drive shaft 42A through gear box 42B and which shaft turns a coupling 20. The coupling is driven by a pin 59 extending through a cross drilled hole in the motor shaft and another pin 33 deployed at 90 degrees to the previous one and which drives the threaded shaft 18. The threaded shaft 18 contains components at its right hand end with a flange that allows the thrust force axially on the shaft to be taken up by a thrust bearing 19 containing two races separated by rolling balls, 30. Any load is conveyed to the base 43 via a race 31 having a partial concave spherical face which engages with a mating convex surface of a part 32 which extends upwardly from the frame 43. This structure allows the lead screw assembly 18 to rotate around a point shown at the center of pin 33.

Figure 7:
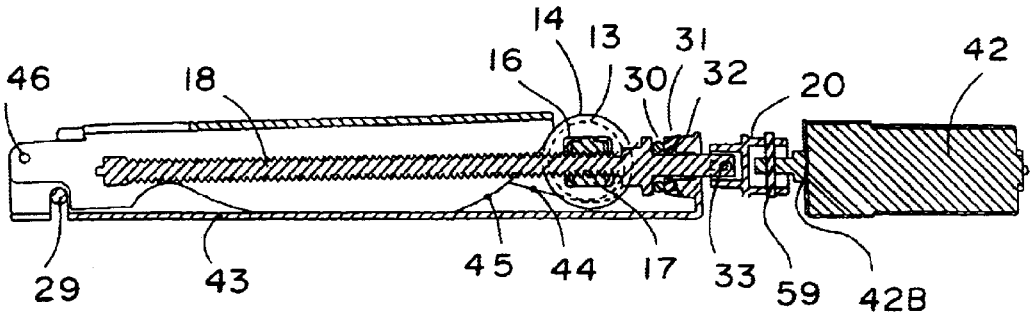
FIG. 7 is a partial cross sectional view taken along line 6—6 of FIG. 5 except with the seat shown in a lowered position.

It can be seen with reference to FIG. 7, which shows the exact same mechanism in FIG. 6 in a lowered position, that the spherical faces on 31 and 32, allow a tilting of the drive screw 18 vertically up and down to effect the desirable compact drive geometry described in FIG. 4.

It should be noted that although pairs of cam plates 44 and 45 and pairs of roller sets 13, 14 are shown in the preferred embodiment, one or more cam plates 44 and 45 and sets of rollers 13, 14 may be used in accordance with the teachings of the invention.

Figure 8:
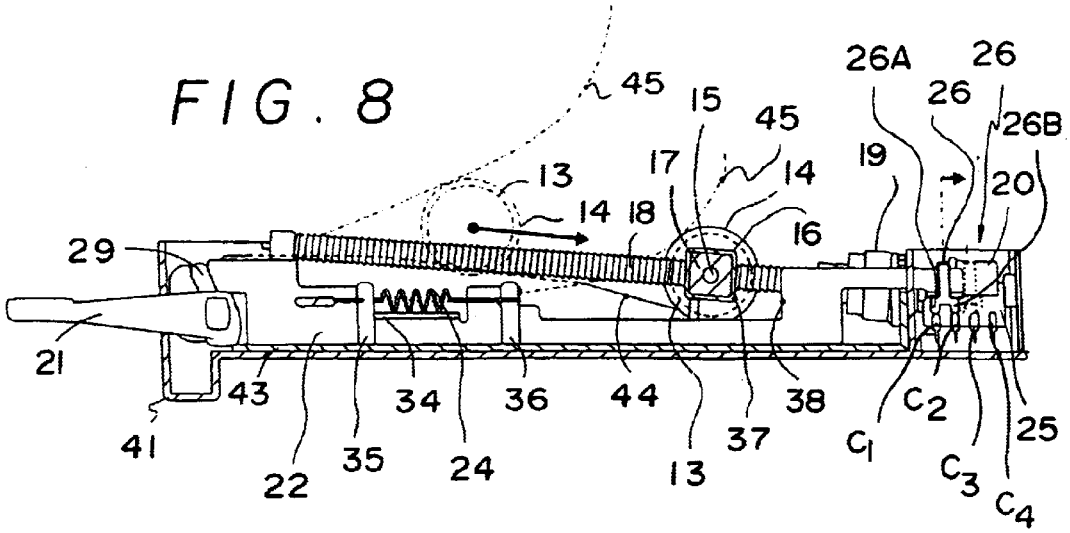
FIG. 8 is a partial cross sectional view of the seat assist device of FIGS. 1, 2 and 5 illustrating switch controls for terminating motor activation as the seat is moved to a fully lowered position.
Figure 9:
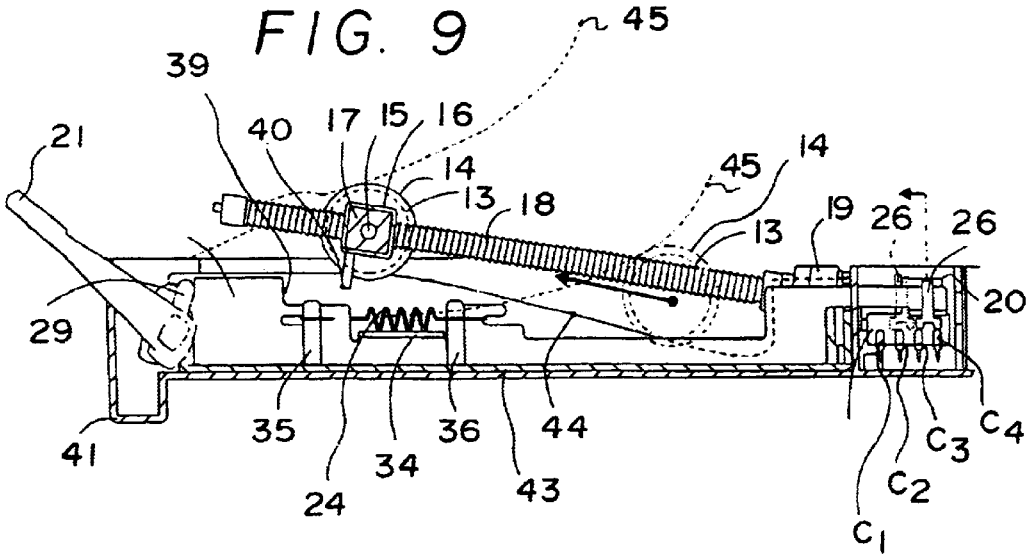
FIG. 9 is a view similar to FIG. 8 illustrating switch controls for terminating motor activation as the seat is moved to a fully raised position.

FIGS. 8 and 9 show the switching arrangements for controlling operation of the motor. It is a difficulty in any mechanical drive system that small high power motors may not be allowed to stall when reaching an end of motion. It is therefore necessary to supply a signal to shut the motor off when reaching either end of its motion when raising and lowering the seat. Starting from the left side of the drawing, the lever 21, by means of a bellcrank at 29, causes switch plate 22 to move fore and aft.

FIG. 8 shows the seat being lowered. The rollers 13 and 14 are moving along the cam plates 44 and 45 in a left to right direction as the seat is being lowered. This is brought about by the user pushing downwards on lever 21, which causes crank arm 29 to urge the slide switch plate 22 to be moved to the leftmost position. It does so against a spring force from spring 24 and whose motion is limited by stops when a flange 34 of the switch plate 22 strikes a fixed base component 35. When the switch plate 22 is in the leftmost position, the toggle switch 26 is held also at its leftmost position, this allows bridge switch contacts 26A and 26B to contacts $C_1$ and $C_2$ in the switch box 25, which, via the H-bridge causes the motor to rotate in the appropriate direction. When the user releases the force on the lever 21, the crank arm 29 is caused to rock to the right, raising the lever 21 by virtue of the spring 24. Therefore the switch 21 has a "deadman" or momentary-on function (i.e. as long as the user keeps the force on the lever the motor runs, when the force is relieved, the motor turns off. This is sometimes an essential safety aspect for lifting devices.)

We now consider the end of stroke detection and means by which the motor is turned off. When the cross beam 16 moves to an extent that it strikes a vertical abutment surface or flange 38 of switch plate 22, it forces the switch plate 22 to the right thus simultaneously and forcefully centering the switch 26 to its intermediate or "off" position as shown in dotted line in FIG. 8, and lifts the lever 21 to its neutral position.

FIG. 9 shows the same assemblies performing a lifting function. In this case, the lever 21 is lifted above its neutral position, rocking the crank arm 29 back and sliding the slide switch plate 22 to its rightmost position thus causing the switch 26 to connect the two rear most contacts $C_3$ and $C_4$ of the motor which can be arranged for, for example, a counter-clockwise rotation of the lead screw 18. Again, the momentary-on function is provided by the spring 24. At the end of lifting motion, a pin 40 which is attached to the cross beam 16 will strike the top edge of the switch plate 22 at vertical edge 39 and this effectively reverses the functions described before on lowering and causes the switch plate to translate to the left thus forcing the handle or lever 21 down to the neutral position and bringing the toggle switch 26 to its central or neutral position.

Sometimes the "deadman" function is not desired. Unhooking either end of the spring 24 or removing the spring entirely can inactivate its function as appropriate. The handle 21 is designed to easily snap on and off. It can also be placed on either side of the seat assist device for convenience. It can be seen that a remote switch or one on a pendant cable could also be used. In this case, the limiting function could be accomplished with limit switches.

As previously described, the arrangement of the vertical rotational axis of the drive nut 17 allows for compliance to twisting. If the cross beam 16 were not free to so swing, inefficiencies would result when the seat is loaded eccentrically. It can be seen that the tilting power screw, coupling, thrust bearing and ball and socket joint scheme described can be accomplished in other ways, notably by using a twisting drive belt or mitered gearing.

With particular reference to FIGS. 10–13, another embodiment of the invention is disclosed. In this embodiment as opposed to allowing the drive element or drive screw 18 to pivot relative to a coupling to the motor, the motor and its operable drive connection to the drive screw, as well as the drive screw itself, are mounted to a pivot plate to the base 41 of the seat assist device.

Figure 10:
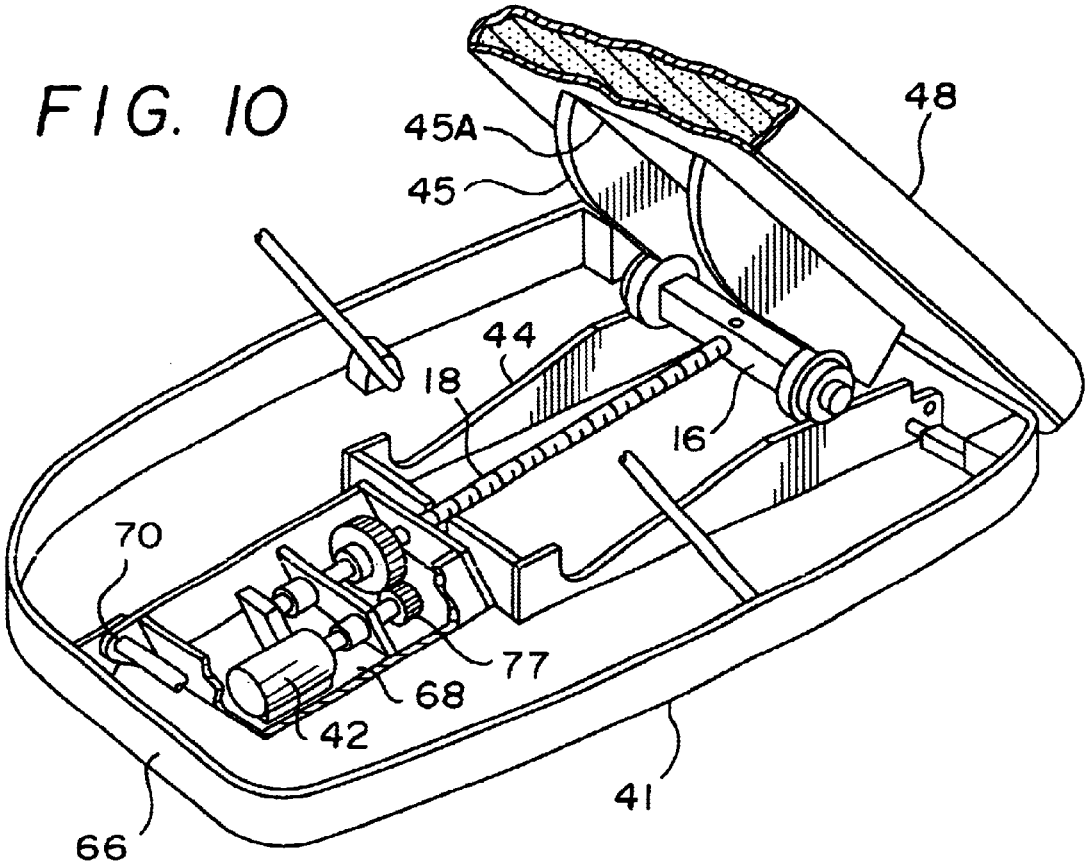
FIG. 10 is a rear perspective view of a second embodiment of the invention showing a motor and gear assembly for driving the drive element of the present invention wherein the motor and gears are pivotally mounted to a base of the seat assist device.
Figure 11:
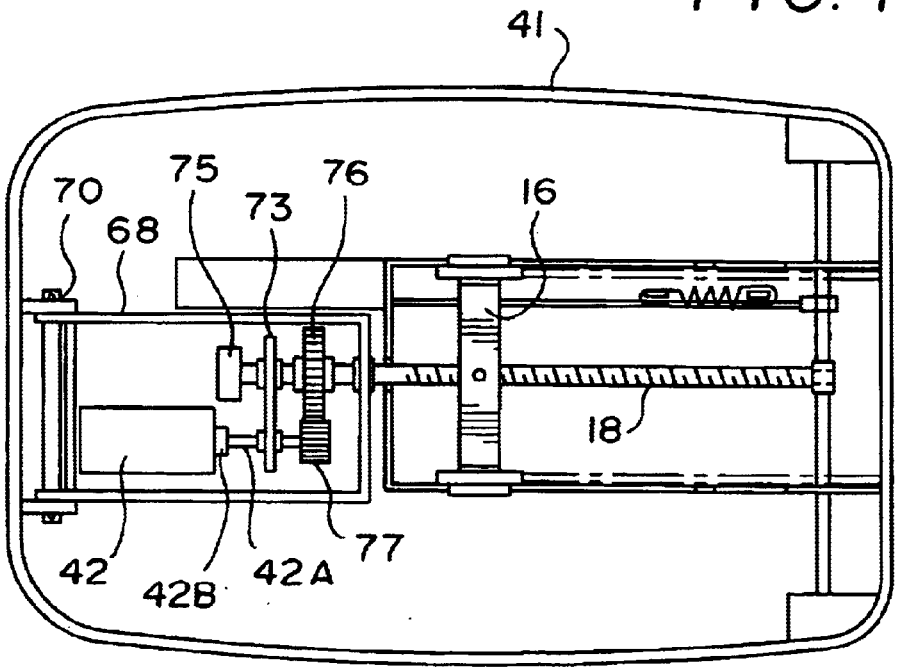
FIG. 11 is a top plan view of the embodiment of FIG. 10.

In FIG. 10, the seat base 41 includes a rear flange 66 to which a motor mounting plate or compartment 68 is pivotally secured at 70. The motor mounting plate includes a forward flange 71 having a bearing 72 therein and which flange is spaced from a secondary flange 73 having a bearing 74 therein. The bearings 72 and 74 support an inner portion of the drive element or screw 18 as shown in the drawing figures with the innermost end of the drive element or screw engaging a thrust bearing 75 also mounted to the motor mounting plate 68.

Figure 12:
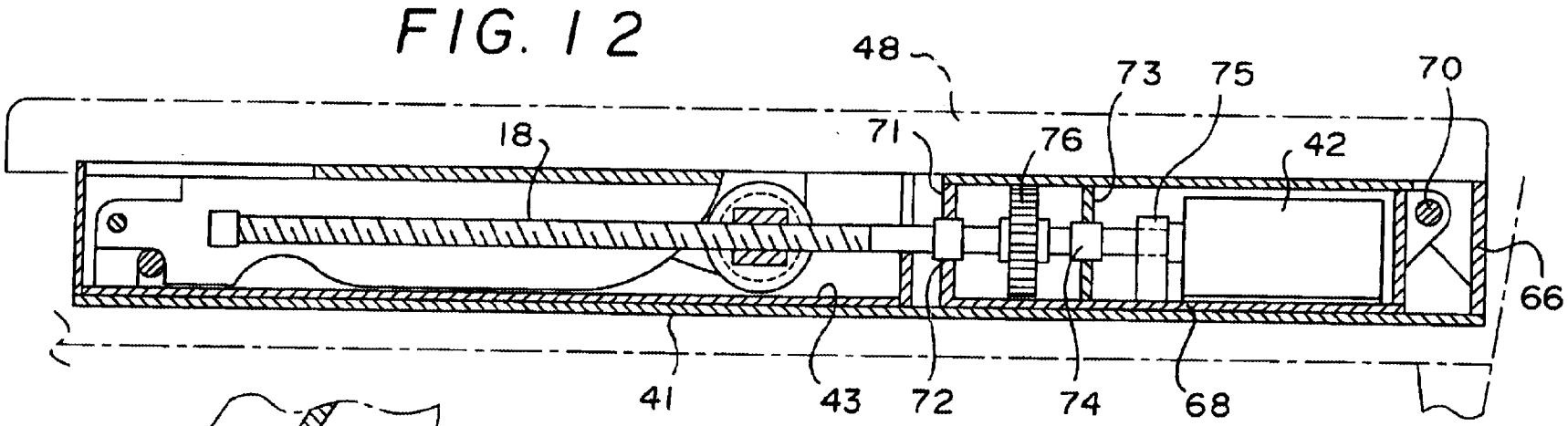
FIG. 12 is an enlarged cross sectioned view taken along lines 12—12 of FIG. 11 showing the seat in dotted line, in a lowered position.
Figure 13:
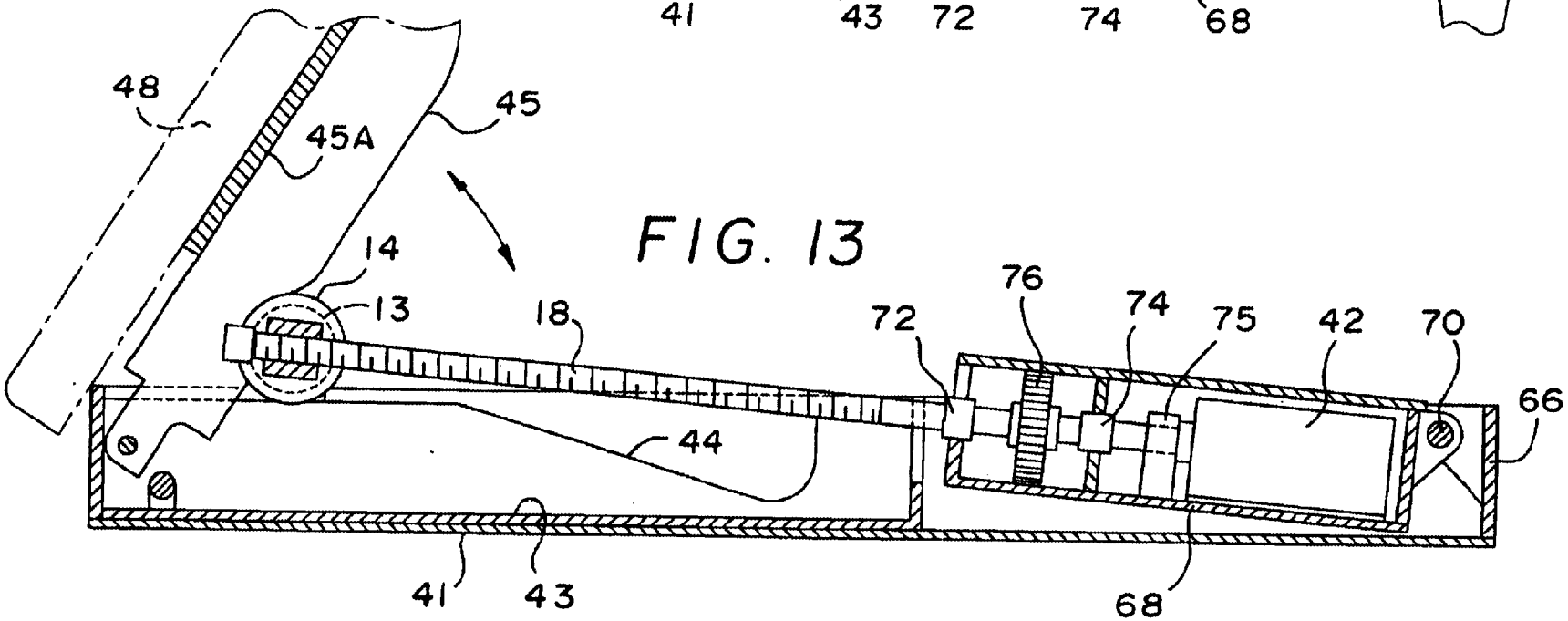
FIG. 13 is a view similar to FIG. 12 showing the seat in a raised position.

In the operation of the embodiment of the invention shown in FIGS. 12 and 13, as the rollers 13, 14 cause the cam members 46 and 45 to raise and lower the seat structure 48 (which is the same as described with respect to the previous embodiment), the angle of the inclination drive screw is vertically changed because the drive screw and the motor 42 are both mounted to the pivotal motor mounting plate 68. In this embodiment, a gear 76 is mounted between the bearings 72 and 74 to the drive element or screw 18. The gear 76 is meshed with a pinion 77 connected to the output drive shaft 42A of the motor 42 by way of the gear box 42B.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

We claim:

1. A seat assist device including a base, a seat, means for pivotally connecting a forward portion of said seat to a forward portion of said base, a mechanism for use in moving said seat relative to said base and including at least one upper cam surface secured to a bottom of said seat and extending from adjacent said forward portion of said seat toward a rear portion of said seat and projecting toward an upper surface of said base and at least one lower cam surface projecting upwardly from said base toward said seat and extending from adjacent a forward portion of said base toward a rear portion of said base, said at least one upper and lower cam surfaces being offset with respect to one another so as to be movable relative to one another in scissored motion between a first position wherein said seat is lowered with respect to said base and a second position wherein said seat is elevated with respect to said base, means for controlling the scissored motion including at least one set of a pair of adjacent rollers which are positioned between said at least one upper cam surface and said at least one lower cam surface such that a first of said rollers engaes said at least one upper cam surface and a second of said rollers engaging said at least one lower cam surface such that said first and second rollers are counter-rotating, connector means pivotal about a horizontal axis for connecting said at least one set of a pair of rollers to a drive member for moving said at least one set of a pair of rollers in a reciprocating motion between said at least one upper and lower cam surface and such that a vertical angle of inclination of said drive means changes as said at least one set of a pair of rollers is moved to raise and lower said at least one upper and lower cam surfaces between said first and second positions, an electric motor mounted adjacent said rear portion of said base, and means for drivingly connecting said motor to said drive member.

2. The seat assist device of claim 1 in which said drive member is a lead screw and said connector means includes a nut driven by said lead screw.

3. The seat assist device of claim 2 wherein said nut is pivotally carried by a beam member such that said beam member is pivotal about an axis substantially normal to rotational axes of said adjacent rollers and said lead screw.

4. The seat assist device of claim 2 in which said means for drivingly connecting said motor to said drive member includes a coupling means having a first end connected to a drive shaft driven by said motor and a second end connected to one end of said lead screw such that said one end is pivotal relative to said coupling means.

5. The seat assist device of claim 4 including a thrust bearing associated with said lead screw, said thrust bearing including a hollow race member carried by said lead screw and a bearing member fixed to said base, said race member and said bearing member including mating curved bearing surfaces.

6. The seat assist device of claim 2 including a motor control means for activating said motor and limit switch means for deactivating said motor when said, at least one upper and lower allowed cam surfaces are in said first and second positions.

7. The seat assist device of claim 6 in which said motor control means includes an operating handle connected to a slide switch operable to move movable spaced electrical contacts relative to spaced electrical contacts of said motor such that when said handle is moved to a first position, relative to a neutral position, said movable spaced electrical contacts associated with said slide switch contact said spaced electrical contacts of said motor to thereby energize said motor.

8. The seat assist device of claim 7 including means for operatively engaging said slide switch to move said movable spaced electrical contacts to an off position relative to said spaced electrical contacts of said motor when said at least one upper and lower cam surfaces are in said first position.

9. The seat assist device of claim 8 wherein said movable spaced electrical contacts associated with said slide switch are movable relative to additional electrical contacts of said motor when said handle is moved to a second position such that said motor operates in a reverse direction, and means carried by said motor control means for engaging said slide switch to disengage said movable spaced electrical contacts associated with said slide switch from said additional electrical contacts when said at least one upper and lower cam surfaces approach said second position.

10. The seat assist device of claim 6 including first and second upper cam surfaces and first and second lower cam surfaces, first and second sets of rollers for engaging said first and second upper and lower cam surfaces, and said connector means including a cross beam to which said first and second sets of rollers are rotatably mounted.

11. The seat assist device of claim 2 including first and second upper cam surfaces and first and second lower cam surfaces, first and second sets of rollers for engaging said first and second upper and lower cam surfaces, and said connector means including a cross beam to which said first and second sets of rollers are rotatably mounted.

12. The seat assist device of claim 1 in which said means for drivingly connecting said motor to said drive member includes a mounting means mounted relative to said base so as to be pivotal vertically with respect to said base, one end of said drive member being rotatably mounted in bearings carried by said mounting means, said motor being carried by said mounting means, and an output from said motor being drivingly connected to said one end of said drive member such that said motor and said drive member are vertically movable with said mounting means.

13. The seat assist device of claim 1 wherein said drive member is pivotally connected relative to said motor.

14. A seat assist device including a base, a seat, means for pivotally attaching a forward portion of said seat to a forward portion of said base, a scissors mechanism for use in moving said seat relative to said base and including first and second upper cam surfaces secured to and extending from a bottom of said seat toward an upper surface of said base, first and second lower cam surfaces extending upwardly from said base toward said seat such that said first lower cam surface is opposing but offset with respect to said first upper cam surface and said second lower cam surface is opposing but offset with respect to said second upper cam surface whereby said first cam surfaces and said second cam surfaces are movable relative to one another in a scissored motion, two sets of rollers, each set of rollers including first and second adjacent rollers mounted to a common roller shaft, each of said sets of rollers being in rolling contact between said upper and lower cam surfaces such that said first rollers engaging said upper cam surfaces and said second rollers engage said lower cam surfaces, a drive member connected to drivingly engaging a beam to which said first and second sets of rollers are rotatably mounted, an electric motor, and means for connecting said electric motor to drive said drive member to thereby move said first and second set of rollers between said upper and lower cam surfaces between first and second positions wherein in said first position said seat is lowered relative to said base and wherein in said second position said seat is elevated with respect to said base.

15. The seat assist device of claim 14 in which said seat includes a living hinge, said first and second upper cam surfaces extending from adjacent said living hinge to said forward portion of said seat.

16. The seat assist device of claim 14 in which said base includes a tray having side portions, and said first and second upper and lower cam surfaces being formed of frames secured to said seat and within said tray, respectively.

17. The seat assist device of claim 14 in which said means for connecting said electric motor to said drive member includes a coupling means which permits said drive member to pivot vertically relative to said motor.

18. The seat assist device of claim 14 in which said means for connecting said electric motor to said drive member includes a mounting means pivotally movable relative to said base in a vertical direction, and said drive member and said electric motor being carried by said mounting means.

19. The seat assist device of claim 14 in which said beam is pivotally connected to said drive member so as to be pivotal about an axis substantially normal to rotational axes of said first and second rollers and said drive member.

20. A seat assist device including a base, a seat, means for pivotally attaching a forward portion of said seat to a forward portion of said base, a scissors mechanism for use in pivoting said seat relative to said base about said means for pivotally attaching and including first and second upper cam surfaces secured to a bottom of said seat and extending from adjacent said forward portion of said seat toward a rear portion of said seat and projecting toward an upper surface of said base, first and second lower cam surfaces projecting upwardly from said base toward said seat and extending from adjacent a forward portion of said base toward a rear portion of said base, two sets of rollers, each set of rollers including first and second rollers mounted on a common support shaft with said first rollers only engaging said upper cam surfaces and said second rollers only engaging said lower cam surfaces such that said fist and second rollers are counter-rotating about said common support shaft, a drive member pivotally connected to drivingly engaging a beam to which said first and second sets of rollers are rotatably mounted in spaced relationship to one another, an electric motor, and means for connecting said electric motor to drive said drive member to thereby move said beam and said first and second set of rollers between said cam surfaces between first and second positions wherein in said first position said seat is lowered relative to said base and wherein in said second position said seat is elevated with respect to said base.

* * * * *